United States Patent [19]

Swearingen

[11] 4,242,040

[45] Dec. 30, 1980

[54] THRUST ADJUSTING MEANS FOR NOZZLE CLAMP RING

[75] Inventor: Judson S. Swearingen, Los Angeles, Calif.

[73] Assignee: Rotoflow Corporation, Los Angeles, Calif.

[21] Appl. No.: 22,417

[22] Filed: Mar. 21, 1979

[51] Int. Cl.[3] ..... F01O 11/00

[52] U.S. Cl. ..... 415/113; 415/163

[58] Field of Search ..... 415/110, 113, 163

[56] References Cited

U.S. PATENT DOCUMENTS

| | | | |
|---|---|---|---|
| 3,232,581 | 2/1966 | Swearingen | 415/163 |
| 3,495,921 | 2/1970 | Swearingen | 415/163 |
| 3,947,147 | 3/1976 | Lortaeva | 415/163 |

*Primary Examiner*—William L. Freeh

*Attorney, Agent, or Firm*—Browning, Bushman & Zamecki

[57] ABSTRACT

The invention comprises a rotary fluid handling apparatus having first and second coaxial bodies mounted for relative axial movement therebetween and having respective opposed radially facing annular surfaces. The bodies may be, for example, the stator of a turboexpander or compressor and a relatively rotatable clamping ring for a plurality of adjustable blades. A first seal including a sealing ring is disposed between and seals between the annular surfaces, and the apparatus defines a first pressure zone which communicates with one axial side of the seal. The first body has a first stop engageable with the sealing ring to permit the force exerted on the sealing ring by the pressure of the first zone to be transmitted to the first body. The second body carries a second stop engageable with the sealing ring to permit the force exerted on the sealing ring by the pressure of the first zone to be transmitted to the second body, and also to retain the sealing ring from force-transmitting engagement with the first stop. The second stop is further releasable to permit force-transmitting engagement between the sealing ring and the first stop.

12 Claims, 5 Drawing Figures

THRUST ADJUSTING MEANS FOR NOZZLE CLAMP RING

BACKGROUND OF THE INVENTION

1. Field of the Invention

The present invention pertains to rotary fluid handling devices, and more particularly to devices such as turboexpanders and compressors. Such a device typically includes a rotor having a series of fluid passageways therethrough, each passageway having one end opening radially outwardly of the rotor. A stator generally surrounds the rotor and supports a number of nozzles communicating with the radial openings of the rotor passageways. Such nozzles are commonly provided on turboexpanders for injecting fluid into the rotor passageways. However, in some cases, such nozzles are also provided in compressor stators to receive fluid from the compressor impeller passageways. In any event, the nozzles may be defined by a number of blades pivotally mounted on the stator. In order to close the axial openings between the blades and also to provide for adjustment of the blade angle, a clamping ring may be provided axially adjacent the blades. This ring is connected to the blades by suitable cam mechanisms, such as pin and slot arrangements, so that, upon rotation of the clamping ring, the angle of the blades will be varied.

In such devices, it is necessary to provide bearing means to support the clamping ring for axial movement and rotation relative to the stator. Also, the radially inner and outer portions of one axial side of the clamping ring may be exposed to different pressure zones of the fluid handling apparatus, and it is desirable to provide a seal between the zones. Finally, it is necessary to provide a means for urging the adjusting ring axially against the nozzle blades with sufficient force to clamp the ring against the blades and thereby close the axial openings therebetween. However, this force should not be so great as to impede the movement of the blades during adjustment.

2. Description of the Prior Art

In prior devices of the type described above, it is customary to form the clamping ring and an adjacent portion of the stator so that they define respective opposed radially facing annular surfaces. Then, a bearing ring may be emplaced between these surfaces to support the clamping ring for axial movement and rotation with respect to the stator. This bearing ring may also serve to seal between radially inner and outer portions of the side of the clamping ring opposite the nozzle blades. Thus, the portion of that side of the clamping ring which is located radially inwardly of the sealing point may be communicated with a zone of the apparatus having a pressure different from that of the zone which communicates with the radially outer portion of that side of the clamping ring.

Accordingly, prior art devices have utilized the pressures of the two aforementioned zones to urge the clamping ring against the nozzle blades, and the position of the sealing point along the radial extent of the clamping ring has been selected to provide a given ratio between the portions of the side of the ring communicated with the high and low pressure zones respectively so as to provide a desired amount of thrust on the clamping ring. However, in practice, it is frequently impossible to precisely predict the seal point location which will result in the proper thrust in a given application. Accordingly, in many instances, it has been found that when the device is placed in operation, too much or too little thrust is imposed on the clamping ring. In such instances, it is necessary to return the device to the manufacturer for modification. This, of course, is relatively expensive and causes undue delay in putting the device to its intended use.

SUMMARY OF THE INVENTION

The present invention provides a means by which the portions of the aforementioned side of the clamping ring which are communicated with the relatively high and low pressure zones respectively may be varied to thereby alter the amount of thrust on the clamping ring. Furthermore, the present invention permits such adjustments to be made at the operation site by the operator, without the need for returning the device to the manufacturer for machining or other expensive types of modification.

More specifically, the present invention comprises a rotary fluid handling apparatus including first and second coaxial bodies mounted for relative axial movement therebetween and having respective opposed radially facing annular surfaces. The first body may be the clamping ring described above, the second body being a related portion of the stator. Bearing means, including a first annular bearing member, are disposed between and seal between the opposed annular surfaces of the two bodies. The apparatus defines at least one pressure zone communicating with one axial side of the bearing means. The invention provides means for causing the axial force exerted on the first bearing member by the pressure of the first zone to be transmitted either to the first body or the second body (i.e. either to the clamping ring or the stator) to thereby vary the thrust on the clamping ring by that amount of force.

In particular, a first stop means is provided on the first body and is engageable with the first bearing member to permit the force exerted on the first bearing member by the pressure of the first zone to be transmitted to the first body. A second stop means on the second body is engageable with the first bearing member to permit such force to be transmitted to the second body. The second stop means, when engaged with the first bearing member, also serves to retain that member from force-transmitting engagement with the first stop means. However, the second stop means is releasable to permit force-transmitting engagement between the first bearing member and the first stop means.

Thus, when the first bearing member is engaged by the second stop means (preferably on the stator), the pressure of the first zone acts against an area on the side of the first body (the clamping ring) which excludes the radial dimension or extent of the bearing member. However, if the second stop is released, the first bearing member is permitted to engage the first stop, and the force of the pressure of the first zone is transmitted to the first body or clamping ring via the bearing member. Accordingly, the area of the clamping ring on which such pressure is exerted will then be increased by the radial dimension or extent of the first bearing member and the force exerted on the clamping ring by such pressure is proportionally increased.

In preferred forms of the invention, each of the two stop means may comprise an axially facing surface for abutment with the side of the first bearing member opposite that which is communicated with the first pressure zone. The stop means of the first body or clamping ring may be formed integrally therewith. However, the stop means of the second body or stator is preferably a stop ring or the like removably mounted in a groove in the annular surface of such body. Thus, the second stop means is released by simply removing it.

In certain embodiments of the invention, two or more bearing members or rings may be provided in coaxially surrounding relation to one another. In such embodiments, a plurality of selectively interchangeable stop rings are also provided. For example, if two such bearing rings are included, one stop ring will be sized to axially abut both of the bearing rings so that neither of them can transmit force to the clamping ring. If that stop ring is replaced by another one sized to abut one of the bearing members but clear the other, so that the latter may assume force-transmitting engagement with the first stop means of the clamping ring, the pressure of the first zone will be transmitted to the clamping ring over an area including the radial extent of the latter of the two bearing rings. Finally, if no stop ring is in place, both bearing rings may engage the stop means of the clamping ring so as to increase the area on which the pressure of the first zone is exerted by the radial dimension of the second bearing ring. Even finer adjustments could be made if three or more bearing rings or members, and an appropriate number of variously sized stop rings, were provided.

Accordingly it is a principal object of the present invention to provide a simple, quick, and inexpensive means for varying the thrust on a nozzle adjusting ring or similar part of a rotary fluid handling device.

Another object of the present invention is to provide a rotary fluid handling apparatus including releaseable stop means for causing pressure exerted on one axial side of a bearing member to be selectively transmitted to either of two coaxial bodies.

Still another object of the present invention is to provide such an apparatus including a plurality of coaxial bearing members for permitting a plurality of different thrust adjustments.

Still other objects, features and advantages of the present invention will be made apparent by the following detailed description of the preferred embodiments, the drawings, and the claims.

DESCRIPTION OF THE PREFERRED EMBODIMENTS

Figure 1:
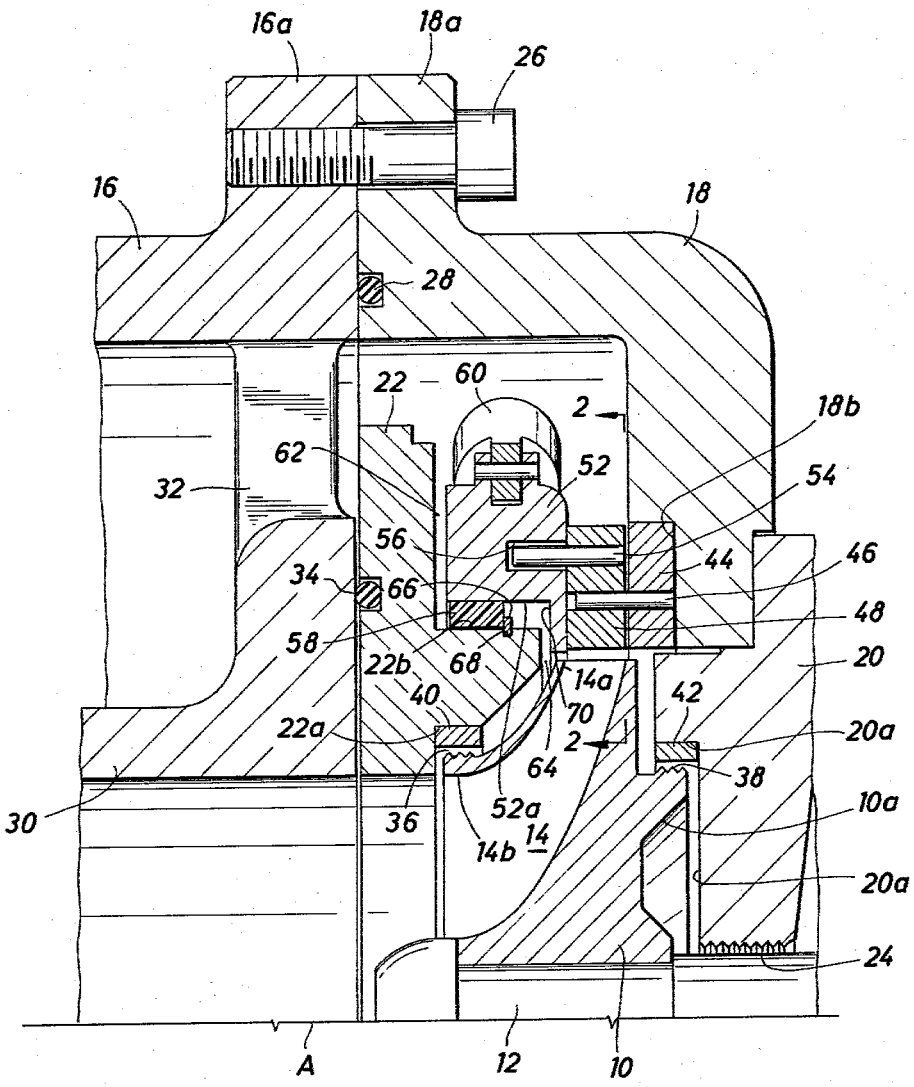
FIG. 1 is a partial axial quarter-sectional view through a turboexpander incorporating a first embodiment of the present invention.

Referring to FIG. 1, there is shown a turboexpander assembly representing a typical type of rotary apparatus or application of the present invention. However, the present invention could be applied to other types of turbines and to compressors, as well as to other kinds of rotary mechanisms. FIG. 1 is a partial quarter-sectional view of the turboexpander, the line A representing the longitudinal axis of the apparatus, and it should be understood that the portion of the apparatus which would be located below line A would generally appear as the mirror image of the part of the apparatus which is shown.

The apparatus comprises two major portions, a rotor and a stator. The rotor 10 is mounted on a shaft 12, which in turn is mounted in suitable bearings (not shown) for rotation about axis A. Rotor 10 has a plurality of fluid passageways therethrough, one of which is shown at 14. The inlet 14*a* of passageway 14 opens generally radially into the outer extremity of rotor 10. From inlet 14*a*, passageway 14 extends radially inwardly and axially to the left (as viewed in the drawing), gradually changing direction so that its outlet 14*b* opens generally axially outwardly of the left-hand end of the rotor. Other passageways identical to passageway 14 and defined by fins or blades are located about the entire circumference of rotor 10 in the well known manner.

The stator, or stationary portion of the turboexpander, includes housing members 16, 18, and 20 and an annular inner member 22. Housing member 20 has an axial end face 20*a* which opposes the closed axial face 10*a* at the right hand end of rotor 10. Member 20 also forms a labyrinth seal 24 about shaft 12 adjacent rotor 10. The portion of member 20 not shown extends axially away from rotor 10 to encase shaft 12 and either form or provide a site for its bearings. Housing member 18 is rigidly attached to housing member 20 by means not shown. Member 18 extends generally radially outwardly from the left end of member 20 and then axially to the left, terminating in an annular radial flange 18*a*. Thus, housing member 18 generally surrounds the major portion of rotor 10 as well as inner stator member 22 and the nozzle and nozzle adjusting means to be described more fully below. Flange 18*a* abuts a similar annular flange 16*a* extending radially from the right end of housing member 16. Flanges 16*a* and 18*a* are secured together by screws, one of which is shown at 26, and their interface is sealed by an O-ring 28.

Integral with housing member 16, and forming a further portion of the stator assembly, are a tubular outlet duct 30 and the fingers 32 of a spider which serves to support duct 30 coaxially within member 16 while still permitting communication between the interiors of housing members 16 and 18. The right end of duct 30 has an enlarged outer diameter, and its right hand end face abuts the left end face of member 22, the latter faces being sealed with respect to each other by an O-ring 34. Member 22 may be rigidly secured either to duct 30 or housing member 18 in any suitable manner, such as that shown in U.S. Pat. No. 3,495,921. To the extent that said prior patent may be helpful in understanding the type of apparatus in which the present invention may be used, it is expressly incorporated herein by reference. Rotor 10 has labyrinth seals 36 and 38 respectively formed about its left and right end portions. Members 22 and 20 are counterbored at 22*a* and 20*a* respectively, and metal rings 40 and 42 are fitted into respective counterbores 22*a* and 20*a* for sealing cooperation with respective seals 36 and 38.

Figure 2:
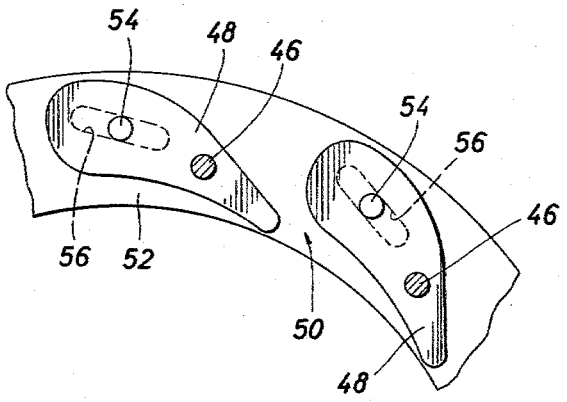
FIG. 2 is a detailed view taken on the line 2—2 in FIG. 1.

The right hand or radially extending portion of housing member 18 has its inner axial face counterbored at 18*b*, and a metal ring 44 is fitted into counterbore 18*b*. Ring 44 receives a plurality of pins 46 which extend axially away from ring 44 to pivotally mount respective ones of a plurality of nozzle blades 48. Blades 48 are arranged about the circumference of rotor 10 in axial alignment with the inlets 14*a* of the rotor passageways. As best seen in FIG. 2, blades 48 are spaced apart so that injection nozzle spaces 50 are defined therebetween.

A clamping ring 52 is disposed on the opposite axial side of blades 48 from ring 44. Each blade 48 receives a respective pin 54 located radially outwardly of the pin 46 and extending axially away from blade 48 into a respective slot 56 in ring 52. As shown in FIG. 2, slots 56 are inclined in a partial-radial-tangential direction to serve as cams for the respective pins 54. Thus, by rotating ring 52, the blades 48 can be simultaneously pivoted about their respective pins 46 to uniformly alter the angles of nozzle spaces 50.

To support ring 52 for such rotation as well as for axial movement, stator member 22 has its right end counterbored to form an annular radially outwardly facing surface 22*b*. Likewise, ring 52 is counterbored from the left to form an opposed annular radially inwardly facing surface 52*a*. A bearing member, in the form of a ring 58 of polytetrafluoroethylene or other suitable material, is disposed between surfaces 22*b* and 52*a* to support ring 52 for axial movement and rotation with respect to the stator, and more particularly with respect to member 22. In order to effect such rotation, an actuator rod 60 is pivotally connected to ring 52 as shown and extends outwardly through a sealed opening in housing member 18.

In operation, high pressure gas is introduced into the interior of housing members 16 and 18. This gas passes through the nozzle spaces 50 defined between blades 48 and into the rotor passageways 14. As the gas passes through passageways 14, it is expanded and causes the rotor 10 to rotate driving shaft 12, which may be utilized to operate any desired machine. The expanded gas is exhausted via duct 30. By operation of actuating rod 60, ring 52 may be rotated on bearing member 58 relative to stator member 22 to vary the angle at which the blades 48 direct gas into rotor passageways 14.

Ring 58 serves not only as a bearing member but also as a seal between radially inner and outer portions of the left side of ring 52, i.e. the side opposed to member 22 and distal the blades 48. As will be explained more fully below, ring 58 may be used in two alternative modes whereby the effective sealing point may be established either at the outer diameter of ring 58 adjacent to surface 52*a* or alternatively at the inner diameter of ring 58 adjacent surface 22*b*. The term "sealing point," used herein for convenience, actually refers to the radius of an annulus defined either by the inner or outer diameter of ring 58.

The normal operation of the turboexpander sets up a number of different pressure zones therein. A first relatively high pressure prevails in the gas which has been introduced into housings 16 and 18 prior to its entry into nozzle spaces 50. Thus, the interiors of housings 16 and 18 upstream of nozzle spaces 50 may be considered a first pressure zone of relatively high pressure, and it can be seen that, in particular, this first zone includes the area 62 located between stator member 22 and ring 52 radially outwardly of bearing member 58. The gas is partially expanded, and thus its pressure lowered, as it passes through nozzle spaces 50. A certain portion of the gas which passes through spaces 50 fails to enter rotor passages 14 but rather leaks into a second pressure zone including the space 64 between stator member 22 and ring 52 radially inwardly of bearing member 58. Thus, the pressures in areas 62 and 64 exert a thrust on ring 52 to urge the ring axially against the adjacent blades 48. This tends to close the axial opening between the blades, leaving only the generally radial openings which communicate with passageway inlets 14*a*, and also to clamp the blades 48 in place. A third area intermediate areas 62 and 64 is also defined between member 22 and ring 52 over the radial extent of bearing member 58, i.e. between surfaces 22*b* and 52*a*. By varying the manner in which ring 58 is mounted in the apparatus, the present invention permits varying of the thrust on ring 52 in this intermediate area.

FIG. 1 shows the first mode, in which a split snap ring 66 is emplaced in an annular groove 68 in surface 22*a* of stator member 22. Ring 66 abuts the right side of bearing member 58. In other words, ring 66 is disposed on the opposite axial side of ring 58 from first or high pressure zone 62. Accordingly, the force of the pressure in area 62, which pressure also prevails in area to the left of ring 58, will be transmitted through rings 58 and 60 to stationary member 22 and will be prevented from acting on ring 52 in the intermediate area between the inner and outer diameters of ring 58, i.e. between surfaces 22*b* and 52*a*. At the same time, fluid in the lower pressure area 64 will pass into the space between members 22 and 52 to the right of ring 58 and will exert an axial thrust on ring 52 in this intermediate area. Accordingly, it may be said that, with the apparatus in the mode illustrated in FIG. 1, the sealing point or sealing annulus is located at the outer diameter of ring 58, or at surface 52*a*, since the high pressure of area 62 acts on ring 52 outwardly of this annulus, and the lower pressure of area 64 acts on ring 52 radially inwardly of this annulus.

Figure 3:
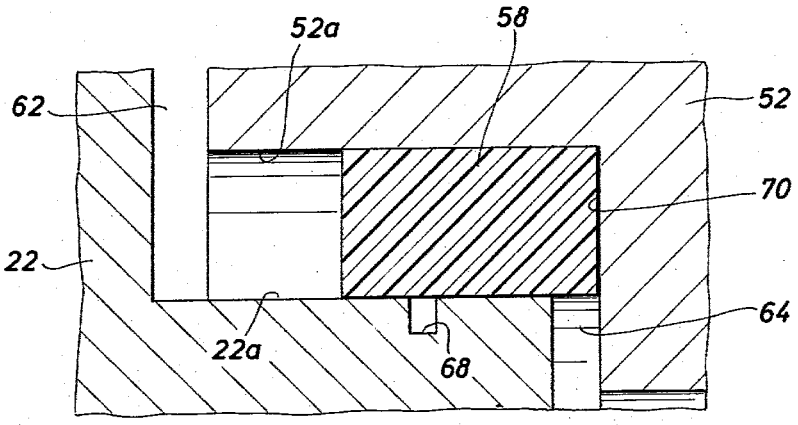
FIG. 3 is an enlarged detailed sectional view of the embodiment of FIG. 1 with the second stop released.

Once the device has been placed in operation in the mode illustrated in FIG. 1, it may be found that the total thrust exerted on ring 52 is insufficient to keep it clamped tightly enough against blades 58. To alleviate such a problem without the necessity for re-machining or other extensive modification of the apparatus, the snap ring 66 may be removed to place the apparatus in the second mode which is illustrated in FIG. 3. The higher pressure of area 62 still acts on the left axial side of ring 58. However, with ring 56 removed, ring 58 is free to slide to the right under the force of this pressure until it abuts axially facing surface 70 of ring 52. Accordingly, the relatively high pressure of area 62 will be transmitted to ring 52 via ring 58. Thus, this higher pressure acts on ring 52 radially outwardly of the inner diameter of ring 58, and the lower pressure of area 64 acts on ring 52 only radially inwardly of the inner diameter of ring 58. Thus, the effective sealing point between the pressures of areas 62 and 64 has been changed from the outer diameter of ring 58, or surface 52*a*, to the inner diameter of ring 58, or surface 22*b*, and the thrust on ring 52 has been increased by applying the higher pressure to the intermediate area defined by the radial extent of ring 58, i.e. generally between surfaces 22*b* and 52*a*.

Conversely, if the apparatus is being used in the mode illustrated in FIG. 3, and it becomes apparent that there is an excessive thrust on ring 52, e.g. such as to impede proper adjustment movements of blades 48, the thrust can be decreased by sliding ring 58 to the left of groove 68 and implacing ring 66 in that groove. Thus, surface 70 of ring 52 may be considered a first stop engageable with ring 58 to permit the force exerted on that ring by the pressure in zone 62 to be transmitted to ring 52. Ring 66 serves as a second stop on stationary member 22 to permit the force exerted on ring 58 by the pressure in zone 62 to be transmitted to member 22 and to retain ring 58 against force-transmitting engagement with surface 70. However, the stop defined by ring 66 is also releasable, by removal of the ring, to permit force-transmitting engagement between ring 58 and stop surface 70 as illustrated in FIG. 3.

Figure 4:
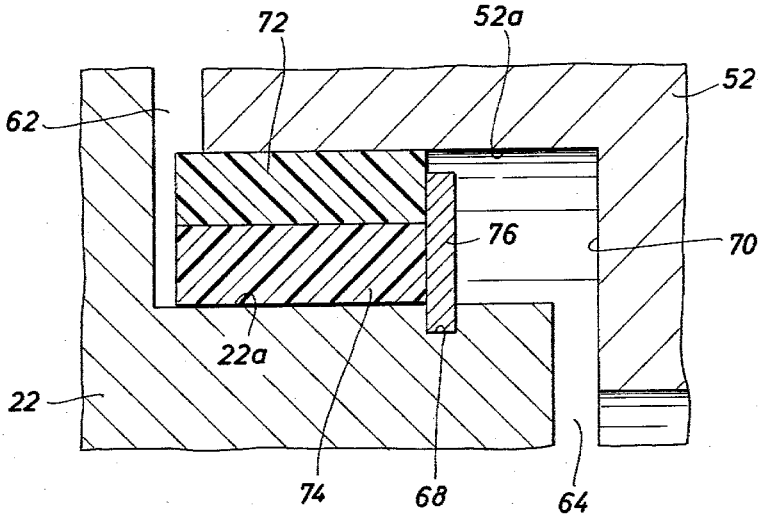
FIG. 4 is a view similar to that of FIG. 2 showing a second embodiment on the invention.
Figure 5:
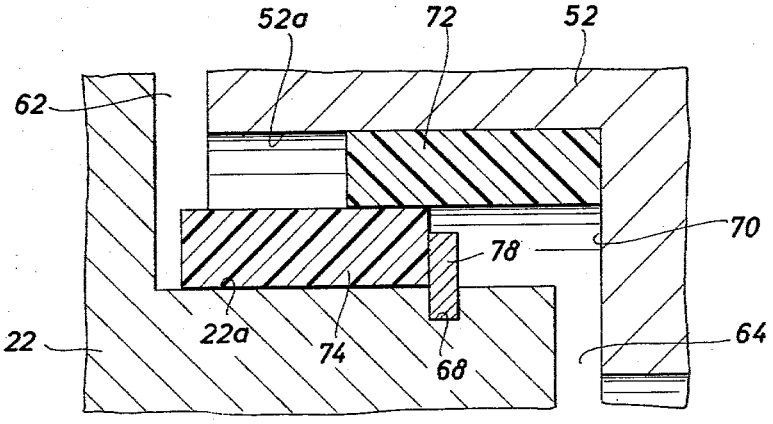
FIG. 5 is a view similar to that of FIG. 3 showing the second embodiment in a second mode of operation.

Referring now to FIGS. 4 and 5, there is shown a modification which permits even finer adjustments of the amount of thrust exerted on ring 52. In particular, the single bearing member on ring 58 has been replaced by a pair of bearing rings 72 and 74. Each of rings 72 and 74 is approximately half as thick as ring 58, and ring 72 is sized to coaxially surround ring 74 whereby the two rings may be positioned in the same intermediate space, between surfaces **22*b* and 52*a*, which was occupied by ring 58 in the first embodiment. The dimensions of rings 72 and 74 are further designed to permit longitudinal sliding movement of the rings with respect to each other as well as to members 52 and 22. However, the fit of the rings on each other and in the space between surfaces 52*a* and 22*b* is sufficiently close so that rings 72 and 74 may serve as a bearing for supporting rotation of ring 52 and also serve as a seal between members 22 and 52 separating the two pressure zones 62 and 64**.

In one mode, illustrated in FIG. 4, a split snap ring 76 is emplaced in groove 68 in member 22. Ring 76 is sized to axially abut both rings 72 and 74 as shown whereby the thrust of the pressure in area 62 communicating with the left hand axial sides of rings 72 and 74 may be transmitted through rings 72 and 74 to ring 76, and ultimately, to stationary member 22. Thus, in the mode of FIG. 4, the pressure of area 62 is transmitted to member 22 over the full radial extent of rings 72 and 74, i.e. over the intermediate area between surfaces **22*b* and 52*a*. Thus, the pressure acting on ring 52 over said intermediate area will be that of zone 64 which can communicate with the portion of the intermediate area to the right of rings 72 and 74 as shown. The thrust exerted on ring 52 when using the apparatus in the mode of FIG. 4 will therefore be equivalent to that of the first embodiment when used in the mode of FIG. 1, and the effective sealing point will be at surface 52*a*, i.e. at the outer diameter of the radially outer ring 72**.

To increase the thrust on ring 52 by a first increment, stop ring 76 may be removed and replaced by a smaller stop ring 78 also sized to fit in groove 68 in member 22. The radial dimension of ring 78 is such that it can abut the innermost bearing ring 74 but not the outer bearing ring 72. Thus, as shown in FIG. 5, outer ring 72 can be moved into engagement with stop surface 70 of ring 52 by the pressure in zone 62 acting on the left axial side of ring 72 whereby the force of such pressure will be transmitted to ring 52 by ring 72. However, since the ring 78 abuts ring 74 and retains it against force-transmitting engagement with stop surface 70, the force of the high pressure in area 62 acting on the left axial side of ring 74 will be transmitted to stationary member 22. Thus, over the radial extent of ring 74, i.e. from the interface between rings 72 and 74 inwardly, the pressure acting on ring 52 will be that of the lower pressure area 64. Therefore, in the mode illustrated in FIG. 5, the effective sealing point is at the interface between rings 72 and 74.

Finally, in another mode (not illustrated) both stop rings 76 and 78 may be removed whereby both bearing rings 72 and 74 may be urged by the pressure of area 62 into abutment with stop surface 70 whereby the higher pressure is transmitted to ring 52 by both bearing members, the thrust on ring 52 is equivalent to that when the first embodiment is used in the mode of FIG. 3, and the effective sealing point is at the inner diameter of ring 74 or at surface **22*a***.

It can thus be seen that the present invention provides a simple means for varying the thrust on a nozzle clamping ring such as ring 52, which means may be employed and adjusted at the operational side of the machine in question. The thrust adjusting means does not require highly complicated mechanisms or special machining or like alterations in the basic apparatus in order to effect thrust adjustment. Furthermore, various embodiments of the invention, such as that illustrated in FIGS. 1 and 3 and that illustrated in FIGS. 4 and 5 may be used interchangably in one apparatus. Thus, for example, if the embodiment of FIGS. 1 and 3 were tested in both modes, and it was found that an intermediate thrust was needed, ring 58 could simply be replaced by the rings 72 and 74 shown in the embodiment of FIGS. 4 and 5, and ring 66, if not small enough to clear ring 72, could be replaced by a ring such as 78 of FIG. 5.

In this regard, it is noted that the stop rings 66, 76 and 78 are preferably each sized to extend radially outwardly a sufficient distance so that the material of respective polymeric rings 58, 72, and 74 will not be extruded over the outer edges of the respective stop rings by force of the pressure in space 62. Likewise, the gap between members 52 and 22 defining space 64 may be sized to prevent extrusion of the polymeric bearing rings thereinto.

It is also noted that numerous modifications of the embodiments shown are possible within the skill of the art. For example, while the invention has been illustrated in connection with varying the thrust on the clamping ring for turboexpander nozzle blades, the principles of the invention could be applied to numerous other types of relatively rotating bodies analogous to members 22 and 52. In other modifications, it might be possible to provide the permanent stop surface, analogous to surface 70, on the fixed body and the releasable stop means, analogous to rings 66, 76, and 78, on the rotating body. Likewise, releasable stop means other than such removable snap rings could be employed. Furthermore, if a finger degree of thrust adjustment is required, it is possible to use three or more coaxially surrounding bearing members with an appropriate number of interchangeable stop means, each of the latter adapted to engage a different number of the bearing members. In such embodiments, the radial thicknesses of the respective bearing member may be equal or unequal, depending upon the thrust increments desired. Still other modifications will suggest themselves to those of skill in the art. Accordingly, it is intended that the scope of the invention be limited only by the claims which follow.

I claim:

1. A rotary fluid handling apparatus comprising:

first and second coaxial bodies mounted for relative axial movement therebetween and having respective opposed radially facing annular surfaces;

seal means disposed between and sealing between said annular surfaces, and comprising a first annular sealing member;

said apparatus defining a first pressure zone communicating with one axial side of said seal means;

first stop means on said first body engageable with said first sealing member to permit the force exerted on said first sealing member by the pressure of said first zone to be transmitted to said first body;

second stop means on said second body engageable with said first sealing member to permit the force exerted on said first sealing member by the pressure of said first zone to be transmitted to said second body and to retain said first sealing member against force-transmitting engagement with said first stop means, said second stop means being releasable to permit force-transmitting engagement between said first sealing member and said first stop means.

2. The apparatus of claim 1 further defining a second pressure zone communicating with the other axial side of said seal means, the pressure of said second zone being less than the pressure of said first zone.

3. The apparatus of claim 2 wherein said seal means further serves as a bearing means supporting said first and second bodies for relative rotation therebetween.

4. The apparatus of claim 3 comprising:

a rotor having radially opening fluid passageway means therein;

a stator generally surrounding said rotor;

blade means pivotally mounted in said stator and defining nozzle means communicating with the radial openings of said fluid passageway means of said rotor;

said second body comprising a portion of said stator;

and said first body comprising a clamping ring axially adjacent and connected to said blade means and rotatable relative to said stator for pivotally adjusting said blades.

5. The apparatus of claim 4 wherein said first and second pressure zones communicate with the opposite axial side of said clamping ring from said blades to urge said clamping ring against said blades.

6. The apparatus of claim 1 wherein each of said stop means comprises a respective axially facing stop surface for abutment with the other axial side of said sealing member to limit axial movement of said sealing member relative to the respective body responsive to the pressure of said first zone.

7. The apparatus of claim 6 wherein said second stop means is removably mounted on said second body to extend from said annular surface of said second body toward said annular surface of said first body.

8. The apparatus of claim 7 wherein said first stop means comprises means integrally extending from said annular surface of said first body toward said annular surface of said second body.

9. The apparatus of claim 7 wherein said second stop means is a stop ring removably mountable in an annular groove in said annular surface of said second body.

10. The apparatus of claim 7 wherein said seal means further comprises an annular second sealing member generally coaxially surrounding said first sealing member and having one axial side communicating with said first pressure zone, and third stop means selectively interchangeable with said second stop means, said first stop means being adapted to engage one or both of said sealing members, said second stop means being so engageable with said first sealing member but not with said second sealing member to permit said second sealing member to engage said first stop means, and said third stop means being so engageable with both of said sealing members to retain both of said sealing members from force-transmitting engagement with said first stop means.

11. The apparatus of claim 10 wherein said second and third stop means comprise respective stop rings removably mountable in an annular groove in said annular surface of said second body.

12. The apparatus of claim 10 further defining a second pressure zone communicating with the other axial side of said seal means, the pressure of said second zone being less than the pressure of said first zone.

* * * * *